US006009979A

United States Patent [19]

Kim

[11] Patent Number: 6,009,979

[45] Date of Patent: Jan. 4, 2000

[54] OUTSIDE UP-DOWN ELEVATOR

[76] Inventor: Kyung-Joo Kim, #102, 29-17, Jamwon-Dong, Seocho-ku, Seoul, Rep. of Korea

[21] Appl. No.: 09/061,627

[22] Filed: Apr. 16, 1998

[30] Foreign Application Priority Data

May 6, 1997 [KR] Rep. of Korea ..... 97-17337

[51] Int. Cl.[7] ..... B66B 9/00

[52] U.S. Cl. ..... 187/239; 182/142

[58] Field of Search ..... 187/406, 407, 187/239, 250; 182/10, 37, 148, 141, 142

[56] References Cited

U.S. PATENT DOCUMENTS

| | | | |
|---|---|---|---|
| 3,586,125 | 6/1971 | Durand | 182/142 |
| 4,225,012 | 9/1980 | Hindle | 182/142 |
| 5,203,265 | 4/1993 | Nii et al. | 105/29.1 |

*Primary Examiner*—Kenneth W. Noland

*Attorney, Agent, or Firm*—Knobbe, Martens, Olson & Bear, LLP

[57] ABSTRACT

An outside up-down elevator, designed to be smoothly and safely raised without an initial downward movement when the outside up-down elevator is restarted in an ascending direction after it is temporarily stopped during an operation, is disclosed. In the outside up-down elevator, a seat frame is moved upward or downward under the guide of two ropes, thereby allowing a worker to work safely and stably without having any intervention between the ropes and the worker. The outside up-down elevator also has a constant speed control means, thus stably and safely descending at a constant speed. Two side walls, respectively enclosing first and second control units, are hinged to both side edges of the seat frame and so the outside up-down elevator can be fully folded suitable for being transported by a user. It is also possible to manually adjust horizontality of the seat frame using two adjusting gears without disassembling the outside up-down elevator.

20 Claims, 12 Drawing Sheets

OUTSIDE UP-DOWN ELEVATOR

BACKGROUND OF THE INVENTION

1. Field of the Invention

The present invention relates, in general, to outside up-down elevators selectively installed on the outer walls of buildings and capable of being vertically movable along the outer walls and, more particularly, to a portable outside up-down elevator designed to be almost completely prevented from an unexpected quick movement, and smoothly raised without an initial downward movement when the outside up-down elevator is restarted in an ascending direction after it is temporarily stopped during an operation.

2. Description of the Prior Art

In a state of emergency, such as a fire, at a multistory building, residents use emergency facilities, such as emergency exits, outside up-down elevators or ladder trucks, in order to escape the emergency and avoid harmful results. However, both conventional outside up-down elevators and emergency exits are typically designed to be enclosed within walls and so they may fail to allow the residents to effectively avoid harmful results in such an emergency. On the other hand, conventional ladder trucks are problematic in that they may fail to effectively rescue the residents of higher stories due to the limited extension of their ladders. During a washing work for cleaning the outer walls of a multistory building, workers use specifically knotted ropes in order to repeatedly stop and descend along the outer walls while washing the outer walls. However, the knots of the ropes may be unexpectedly loosened and result in safety hazards. Another problem experienced in such ropes used in washing the outer walls of buildings is that the ropes do not allow workers to ascend along the outer walls.

In an effort to overcome the above problems, the applicant of this invention proposed a safety outside up-down elevator in Korean Patent Publication No. 95-4519. As shown in FIG. 1 of the accompanying drawings of this invention, the safety outside up-down elevator is designed to be motor-operated or manually operated so as to ascend or descend. The outside up-down elevator is also selectively stopped when there is an obstacle in an outside up-down elevator's moving passage while descending, and it is raised in order to avoid the obstacle.

As shown in the drawing, the safety outside up-down elevator comprises a planetary-type gear box, which is comprised of one sun gear 64, a plurality of planetary gears 66, 67, 68 and one internal gear 70. The three planetary gears 66 to 68 commonly and externally engage with the sun gear 64, while the internal gear 70 internally engages with the three planetary gears 66 to 68. A shaft 12 is rotatably coupled to the end plate 80 of the gear box, while the internal gear 70 is fixedly screwed to the end plate 80. A planetary gear carrier 65 is rotatably fitted over the shaft 12, with the top surface of the gear carrier 65 carrying the three planetary gears 66 to 68 and the bottom surface being concentrically integrated with a pulley 69. The pulley 69 has an annular groove on its outer surface, thus allowing a rope 11 to be wrapped around.

The sun gear 64 is set between the three planetary gears 66 to 68 so as to engage with the planetary gears 66 to 68. Fitted over the shaft 12 at a position just above the sun gear 64 is a flywheel 60, with a brake weight 63 being set in an arcuate groove 62 formed on the outer surface of the flywheel's rim 61. A cap-shaped cover 55 is fitted over the top of the flywheel 60, thus covering the flywheel 60.

The end plate 80 is provided with three rollers 76, 77 and 78, which guide the rope 11 to the pulley 69 and thereby allow the rope 11 to be wrapped around the pulley 69.

A brake band 50 is set in the cover 55, with one end of the band 50 being hinged to the cover 55 and the other end being connected to a lever 51. The above brake band 50 is brought into close contact with the outer surface of the flywheel 60. In order to elastically bias the brake band 50 to the outer surface of the flywheel 60, both the lever 51 and one spring 52 are coupled to a hinge 53. Due to the spring 52, the brake band 50 always comes into close contact with the outer surface of the flywheel 60. The lever 51 is selectively turned, thus releasing the flywheel 60 from the brake band 50 and allowing the flywheel 60 to be rotatable.

In the operation of the above safety outside up-down elevator, the outside up-down elevator descends under the weight of a user when the flywheel 60 is released from the brake band 50 by operating the lever 51. In such a case, the pulley 69 of the planetary gear carrier 65 is rotated at a low speed, thus allowing the pulley 69 of the gear carrier 65 to be rotatable at a reduction speed ratio of the pulley 69 to the sun gear 64 of the flywheel 60. The flywheel 60 thus generates a centrifugal force, bringing the brake weight 63 into frictional contact with the brake band 50 and increasing the rotation load of the flywheel 60. Due to such an increase in the flywheel's rotation load, the rotating speed of the gear carrier's pulley 69 is reduced, while the frictional force between each of the three rollers 76 to 78 and the rope 11 is increased. It is thus possible to allow the outside up-down elevator to descend at a low speed.

When there is an obstacle in the moving passage of the outside up-down elevator while the outside up-down elevator descends at such a low speed, the lowering action of the outside up-down elevator may be stopped by removing the external force from the lever 51. When the lever 51 is free from the external force as described above, the brake band 50 is elastically biased by the spring 52, thus being brought into close contact with the outer surface of the flywheel 60 and braking the flywheel 60. The lowering action of the outside up-down elevator is thus stopped.

However, the above safety outside up-down elevator has the following problems.

First, when the lever 51 is operated to release the brake band 50 and lift the outside up-down elevator after the outside up-down elevator is stopped during such a lowering action of the outside up-down elevator, the outside up-down elevator may unexpectedly initially move downward momentarily. That is, the outside up-down elevator in the above state descends a certain distance momentarily from the time the brake band 50 is released to the time a lifting force is given to the outside up-down elevator, thus unexpectedly running against the obstacle in the moving passage and causing a safety hazard.

Second, the brake weight 63 is movably received in the arcuate groove 62 formed on the outer surface of the flywheel's rim 61, thus generating upsetting noises while the outside up-down elevator is transported.

Third, the outside up-down elevator is designed to be moved along a single rope 11 and so it is almost impossible to stably or safely operate the outside up-down elevator. The outside up-down elevator also fails to allow a worker to be effectively balanced thereon or take working instruments. The rope 11 also extends just in front of a worker, thus disturbing the worker while working.

SUMMARY OF THE INVENTION

Accordingly, the present invention has been made keeping in mind the above problems occurring in the prior art, and an object of the present invention is to provide an outside up-down elevator, which is designed to be smoothly raised without an initial downward movement when the outside up-down elevator is restarted in an ascending direction after it is temporarily stopped during an operation.

It is another object of the present invention to provide a portable outside up-down elevator, which stably and safely descends at a constant speed during a lowering action.

It is a further object of the present invention to provide an outside up-down elevator, which allows a worker to work safely and stably and removes any intervention between a rope and the worker.

In order to accomplish the above object, the present invention provides an outside up-down elevator comprising: a folding seat frame used for taking on a passenger; at least two ropes or first and second ropes attached to a building; a first control unit provided at one side wall of the seat frame and adapted for winding the first rope in a specific pattern; a drive motor used for generating a rotating force, thus selectively operating the first control unit; a second control unit provided at opposite side wall of the seat frame and adapted for winding the second rope in a specific pattern; power transmission means for transmitting the rotating force of the drive motor to the second control unit; and braking means for selectively braking and stopping the seat frame during a lowering action of the seat frame, wherein the seat frame is selectively raised along the ropes by the rotating force of the drive motor or descends due to the total weight of the seat frame including the weight of the person when the drive motor is turned off.

In the preferred embodiment, the first control unit comprises: a first casing provided with rope inlet and outlet ports for the first rope with the interior of the casing being divided into regular sections by a plurality of intermediate plates; a first main pulley provided in the first casing and having a rope wrapping groove on its outer surface, the first main pulley being operated by the rotating force of the drive motor; and a first speed control means adapted for controlling a rotating speed of the first main pulley.

The second control unit comprises: a second casing provided with rope inlet and outlet ports for the second rope with the interior of the casing being divided into regular sections by a plurality of intermediate plates; a second main pulley provided in the second casing and having a rope wrapping groove on its outer surface, the second main pulley being operated by the rotating force of the drive motor transmitted thereto through the power transmission means; and a second speed control means adapted for controlling a rotating speed of the second main pulley.

The outside up-down elevator further comprises constant speed control means used for allowing the seat frame to move at a constant speed when the seat frame descends along the two ropes under the control of the first and second control units.

In the outside up-down elevator of this invention, the seat frame allows a worker to stably and safely work using the outside up-down elevator. In addition, the constant speed control means allows the seat frame to be lowered at a constant speed and so it is possible to precisely and stably control the working position and the operation of the outside up-down elevator.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
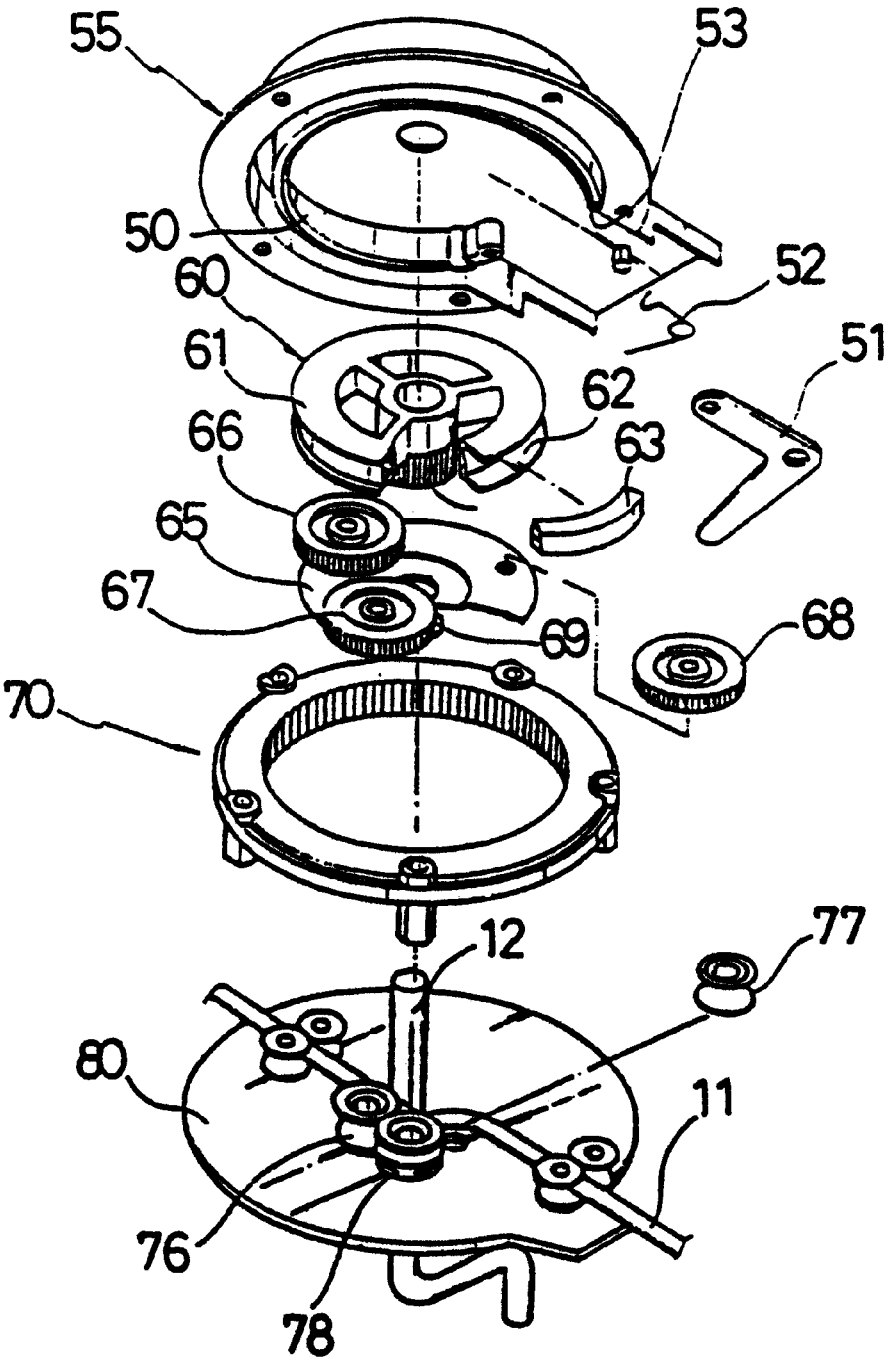
FIG. 1 CONVENTIONAL ART
FIG. 1 is an exploded perspective view showing the construction of a planetary-type gear box included in a conventional outside up-down elevator.
Figure 2:
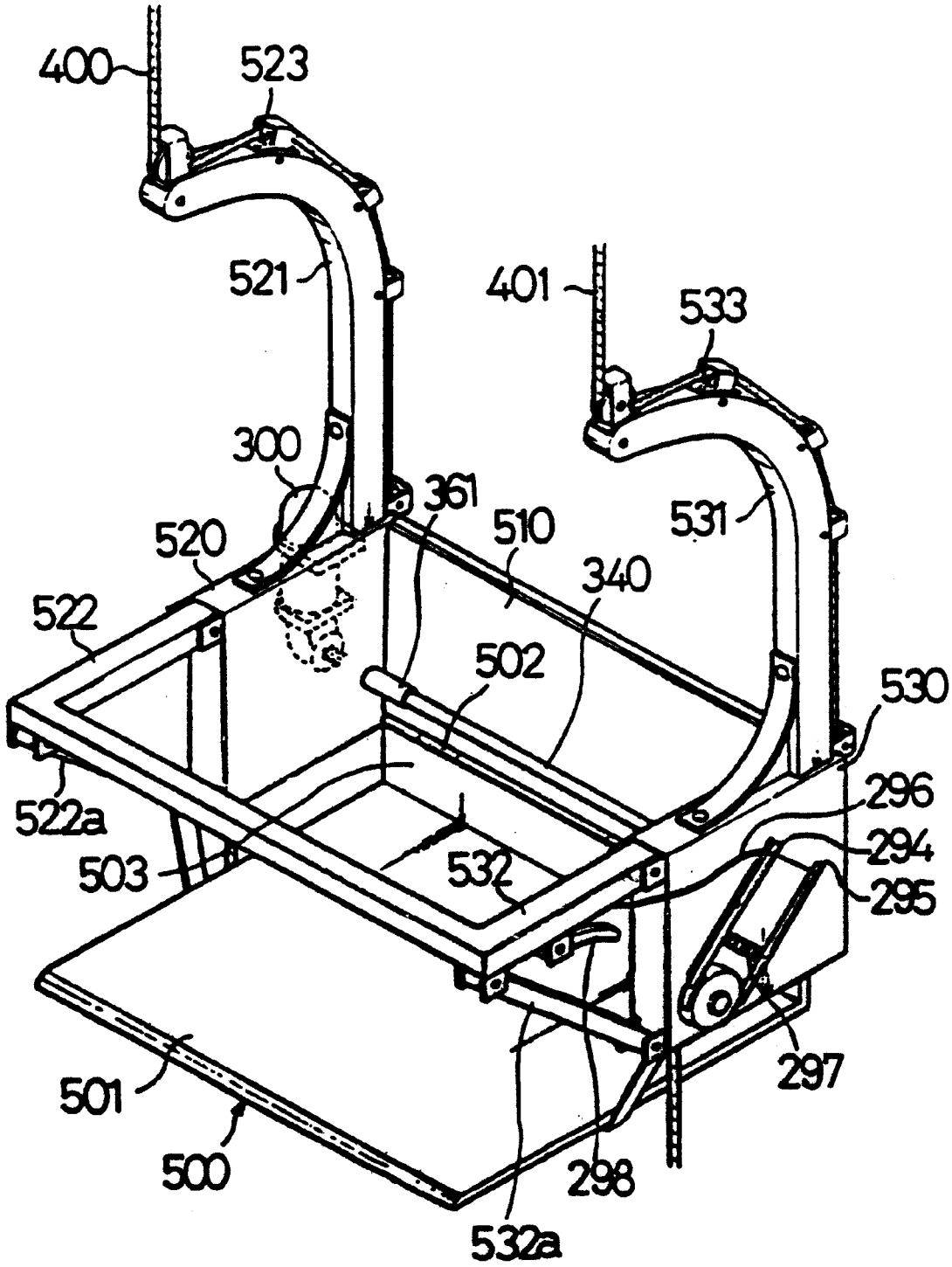
FIGS. 2 and 3 are perspective views of an outside up-down elevator in accordance with the preferred embodiment of the present invention.
Figure 3:
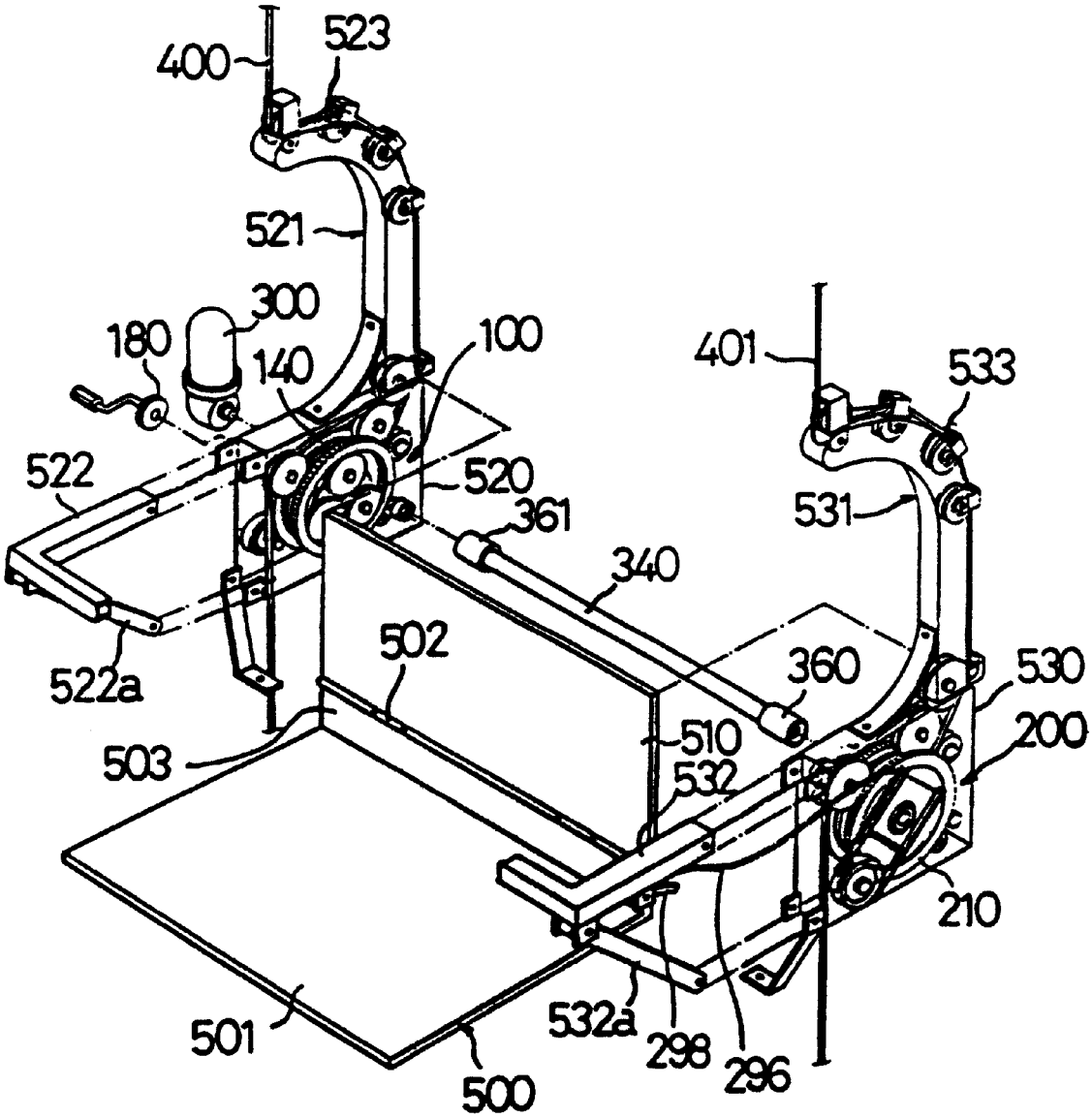
Figure 4:
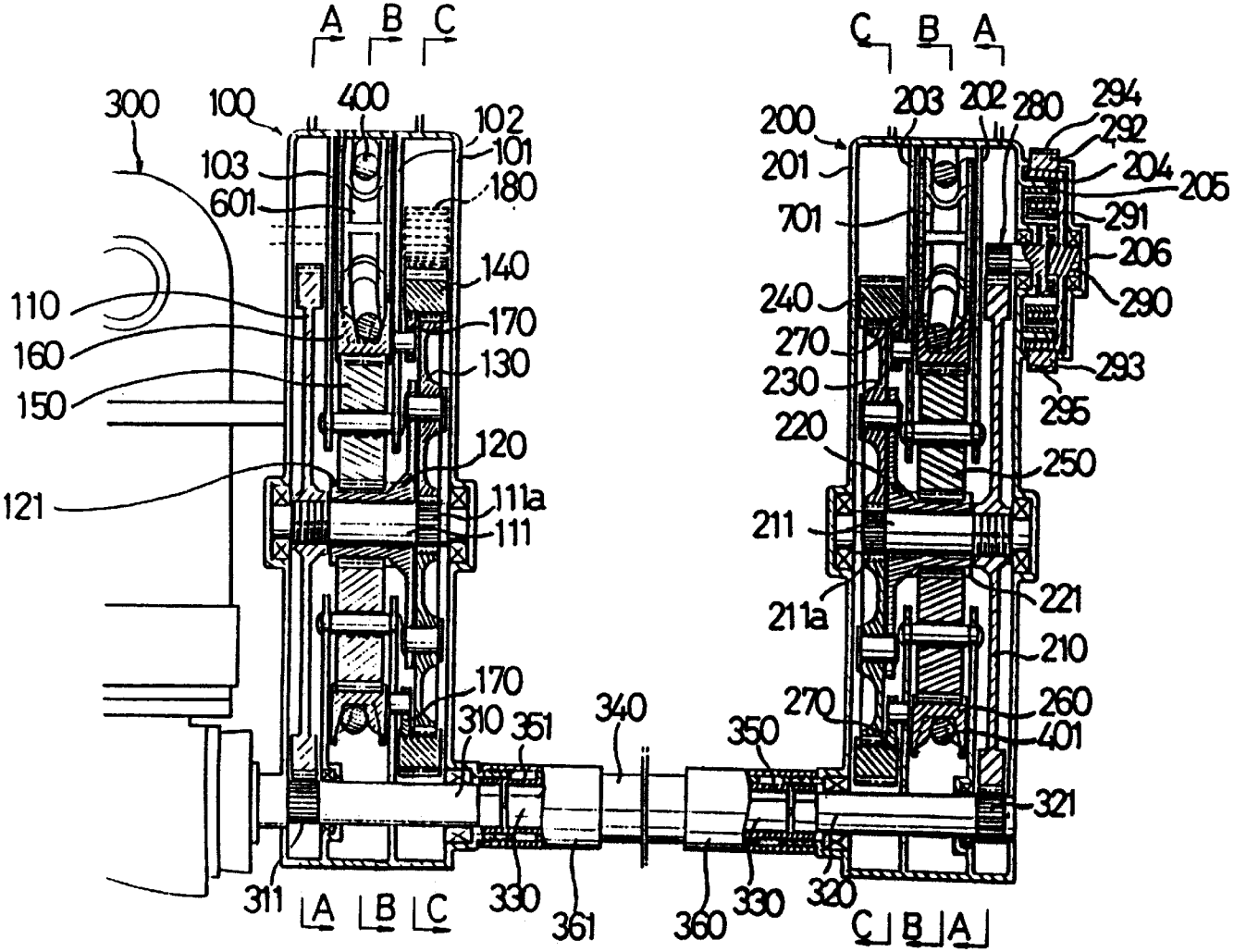
FIG. 4 is a sectional view showing the construction of first and second control units included in the outside up-down elevator of this invention.
Figure 5:
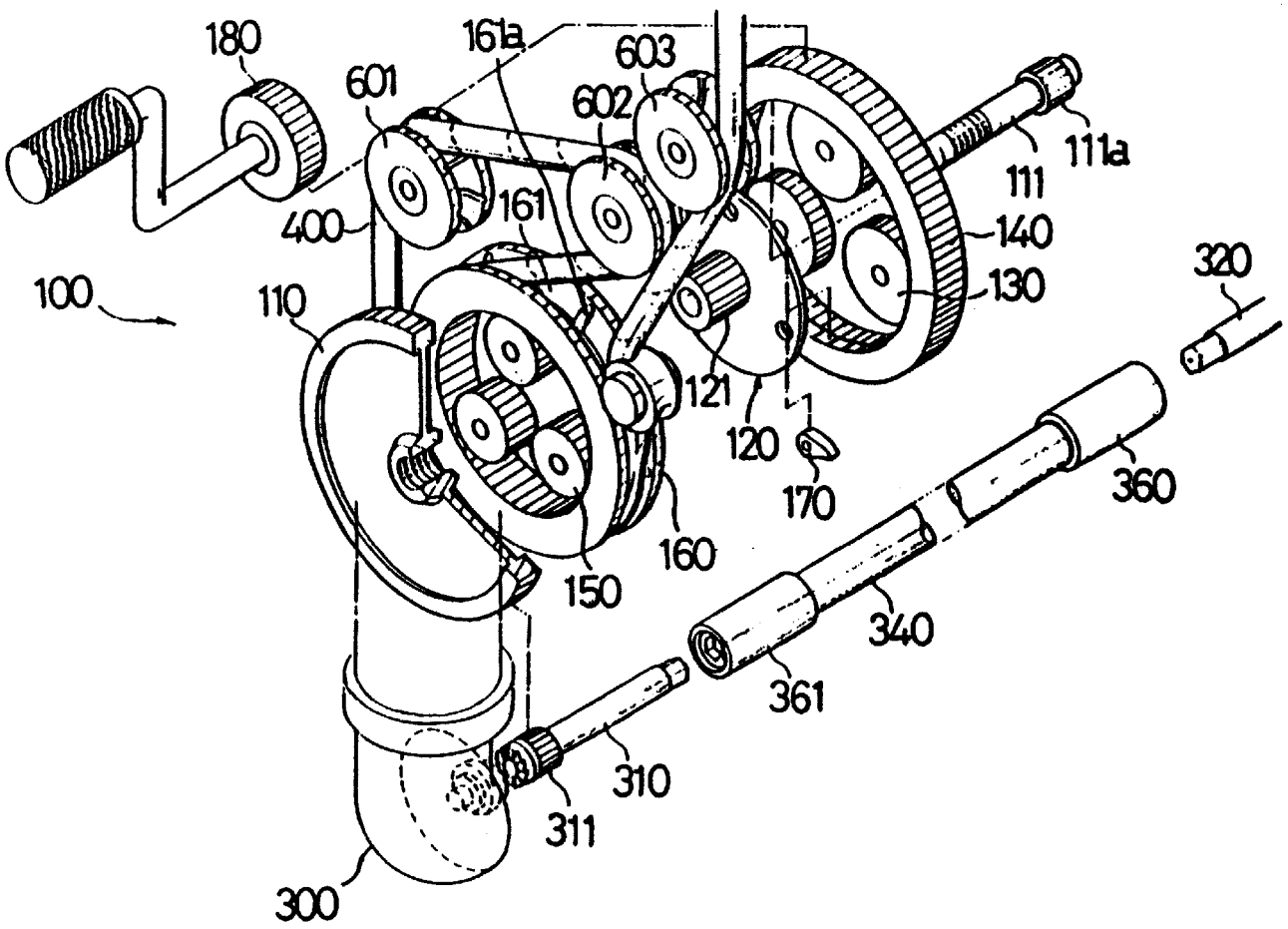
FIG. 5 is a perspective view showing the construction of the first control unit of this invention.

FIGS. 2 and 3 are perspective views of an outside up-down elevator in accordance with the preferred embodiment of the present invention. FIG. 4 is a sectional view showing the construction of a drive unit included in the outside up-down elevator of this invention. The outside up-down elevator of this invention is effectively used for escaping out of multistory building in emergency and washing or painting the outer walls of multistory buildings.

As shown in the drawings, the outside up-down elevator of this invention comprises a seat frame 500 allowing a person to be seated in the outside up-down elevator. The outside up-down elevator also includes a pair of ropes or first and second ropes 400 and 401, one end of each of which is connected to a building (not shown). A first control unit 100 is provided at one side wall of the seat frame 500 for winding the first rope 400 in a specific pattern. The first control unit 100 is operated by a drive motor 300. A second control unit 200 is provided at the other side wall of the seat frame 500 for winding the second rope 401 in a specific pattern. The rotating force of the drive motor 300 is transmitted to the second control unit 200 through a power transmission means, thus operating the second control unit 200. The outside up-down elevator further includes a braking means for selectively braking and stopping the seat frame 500 during a lowering action of the seat frame 500. In the above outside up-down elevator, the seat frame 500 is raised along the ropes 400 and 401 by the rotating force of the drive motor 300 and descends by the total weight of the frame 500 when the drive motor 300 is turned off.

The seat frame 500 comprises a bottom panel 501, a vertical connection wall 503 and a back wall 510. The bottom panel 501 allows a passenger to be seated, while the vertical connection wall 503 extends from the rear edge of the bottom panel 501 to a height. The back wall 510 is jointed to the top edge of the connection wall 503 through a plurality of hinges 502 and allows a passenger to lean back against it.

Figure 12:
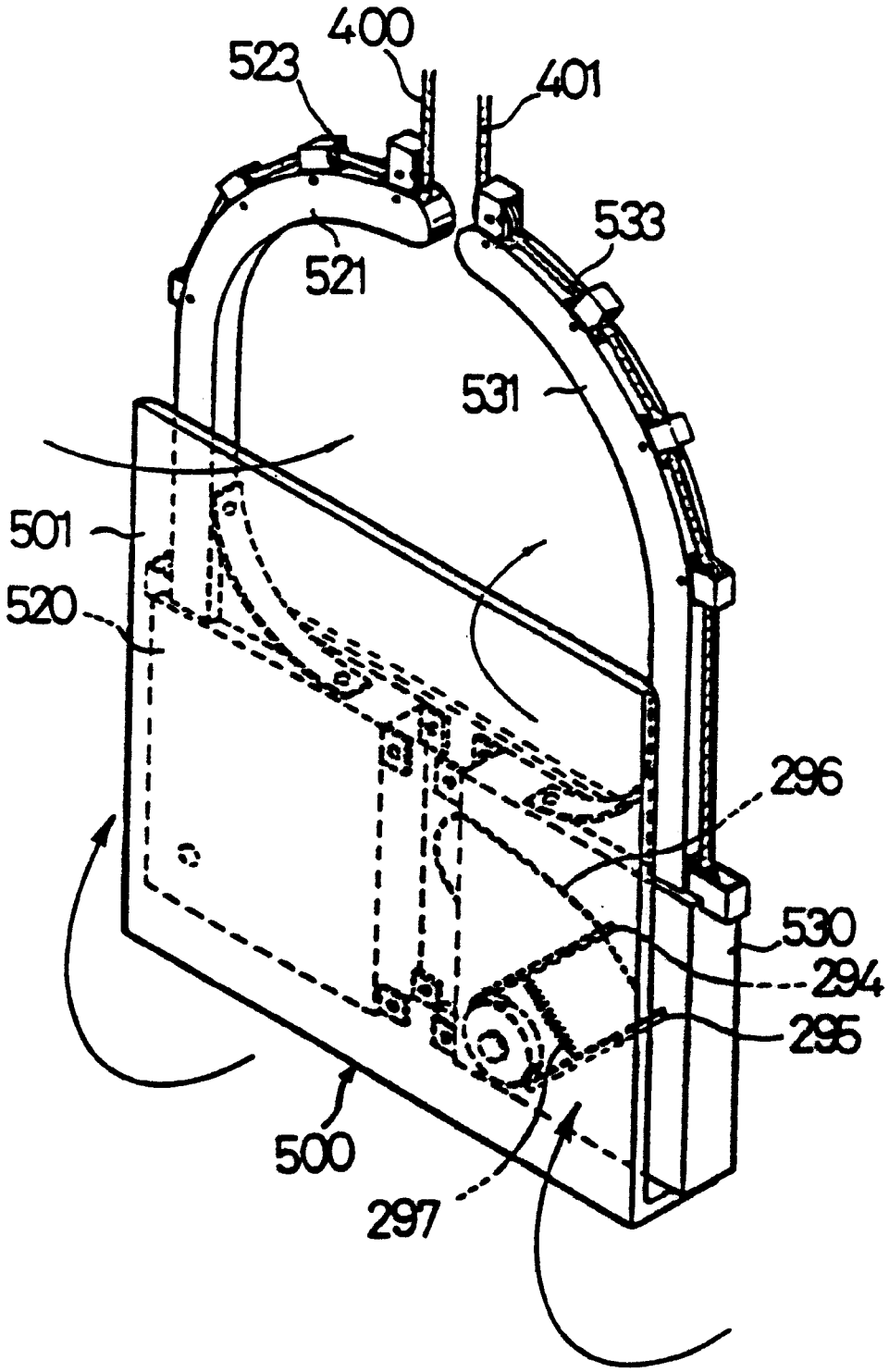
FIG. 12 is a perspective view of the outside up-down elevator of this invention when the outside up-down elevator is fully folded, thus being suitable for being transported by a user.

Two side walls 520 and 530, respectively receiving the first and second control units 100 and 200, are jointed to both side edges of the back wall 510 through a plurality of hinges (not shown). Each of the two side walls 520 and 530 has a guide member 521, 531 used for guiding an associated rope 400, 401. The two side walls 520 and 530, individually having one guide member 521, 531, are designed to be selectively closed and interposed between the bottom panel 501, the connection wall 503 and the back wall 510 when the outside up-down elevator is fully folded suitable for being transported by a user as shown in FIG. 12.

Each of the two guide members 521 and 531 is smoothly curved so as to effectively guide the rope 400, 401 from the center of each side edge of the bottom panel 501 to the back wall 510. The guide members 521 and 531 are individually provided with a plurality of guide rollers 523, 533 for smoothly guiding the rope 400, 401 to the back wall 510. The above guide members 521 and 531 thus almost completely prevent any intervention between a passenger and the ropes 400 and 401 when the passenger in the outside up-down elevator washes or paints an outer wall of a building.

Each of the two guide members 521 and 531 is provided with a hinged railing 522, 532, which is supported by a support 522*a*, 532*a*.

As shown in FIGS. 4, 5, 9, 10 and 11, the first control unit 100 comprises a first casing 101, a first main pulley 160 and a first speed control means. The first casing 101 has a cavity, rope inlet and outlet ports for the first rope 400 and two intermediate plates 102 and 103 dividing the cavity into regular sections. The first main pulley 160, which is provided in the first casing 101 and has a rope wrapping groove 161 on its outer surface, is operated by the rotating force of the drive motor 300. The first speed control means is for controlling the rotating speed of the pulley 160.

The above first speed control means is comprised as follows: The first speed control means includes the first main pulley 160, which is an annular member with a gear part being formed on the inner surface of the annular member. The first speed control means also includes a first shaft 111, which is rotatably mounted to the first casing 101 and has a first sun gear 111*a* at one end thereof. A first master drive member 110 is fitted over the other end of the first shaft 111 and is connected to the drive motor 300, thus being operated by the rotating force of the motor 300. A first gear carrier 120 is rotatably fitted over the middle portion of the first shaft 111 and has a second sun gear 121 at the center of its outer surface. A plurality of first planetary gears 130 are rotatably held on the gear carrier 120 at regular intervals, and commonly and externally engage with the first sun gear 111*a*. A first ring gear 140 is fixed to the first casing 101 through a first fixing means and internally engages with the first planetary gears 130. The first speed control means further includes a plurality of second planetary gears 150, which are rotatably positioned between the intermediate plates 102 and 103 at regular intervals. The second planetary gears 150 also commonly and externally engage with the second sun gear 121, and internally engage with the gear part of the first main pulley 160.

In the above first speed control means, the first fixing means includes a first click 170, which is rotatably mounted to the intermediate plate 102 and engages with the inner gear part of the first ring gear 140. The first click 170 thus only allows the ring gear 140 to be rotatable in one direction.

When the seat frame 500 is raised by the rotating force of the drive motor 300, the first speed control means reduces the rotating speed of the first main pulley 160, thus allowing the seat frame 500 to be raised at a low speed. Meanwhile, when the drive motor 300 is turned off, the seat frame 500 descends due to its total weight. In such a case, the rotating speed of the first main pulley 160 is increased. When the seat frame 500 descends as described above, the frame 500 moves at a constant speed under the control of a constant speed control means as will be described later herein.

As shown in FIGS. 4, 5, 9, 10 and 11, the second control unit 200 comprises a second casing 201, a second main pulley 260 and a second speed control means. The second casing 201 has a cavity, rope inlet and outlet ports for the second rope 401 and two intermediate plates 202 and 203 dividing the cavity into regular sections. The second main pulley 260, which is provided in the second casing 201 and has a rope wrapping groove 261 on its outer surface, is operated by the rotating force of the drive motor 300 which is applied to the pulley 260 through the power transmission means. The second speed control means is for controlling the rotating speed of the second main pulley 260.

The above second speed control means is comprised as follows: The second speed control means includes the second main pulley 260, which is an annular member with a gear part being formed on the inner surface of the annular member. The second speed control means also includes a second shaft 211, which is rotatably mounted to the second casing 201 and has a third sun gear 211*a* at one end thereof. A second master drive member 210 is fitted over the other end of the second shaft 211 and is connected to the drive motor 300, thus being operated by the rotating force of the motor 300. A second gear carrier 220 is rotatably fitted over the middle portion of the second shaft 211 and has a fourth sun gear 221 at the center of its outer surface. A plurality of third planetary gears 230 are rotatably held on the gear carrier 220 at regular intervals and commonly and externally engage with the third sun gear 211*a*. A second ring gear 240 is fixed to the second casing 201 through a second fixing means and internally engages with the third planetary gears 230. The second speed control means further includes a plurality of fourth planetary gears 250, which are rotatably positioned between the intermediate plates 202 and 203 at regular intervals. The fourth planetary gears 250 also commonly and externally engage with the fourth sun gear 221, and internally engage with the gear part of the second main pulley 260.

In the above second speed control means, the second fixing means includes a second click 270, which is rotatably mounted to the intermediate plate 203 and engages with the inner gear part of the second ring gear 240. The second click 270 thus only allows the ring gear 240 to be rotatable in one direction.

The operational effect of the second speed control means is equal to that of the first speed control means.

Figure 6:
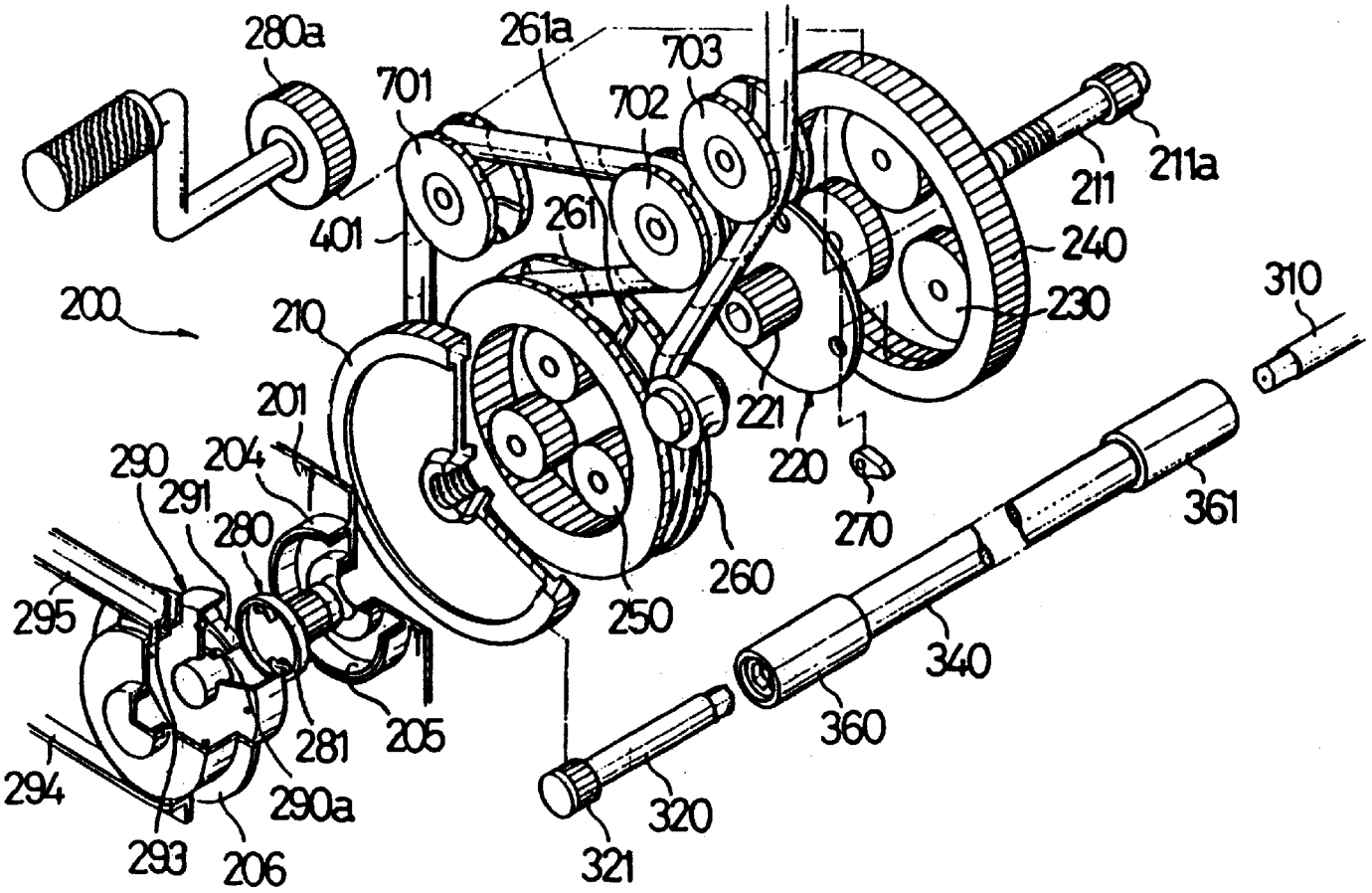
FIG. 6 is a perspective view showing the construction of the second control unit of this invention.

The constant speed control means, which controls the seat frame 500 so as to allow the frame 500 to move at a constant speed when the frame 500 descends along the ropes 400 and 401 under the control of the first and second control units 100 and 200, is comprised as follows:

As shown in FIGS. 4 and 6, a serve case 206 is provided at the outer surface of the second casing 201 and defines a space, while an annular rib 204 extends from the second casing 201 into the space of the serve case 206. A frictional pad 205 is provided on the inner surface of the annular rib 204. A drive rotor 280 is rotatably mounted to the second casing 201 and rotatably engages with the second master drive member 210 at one end thereof. The other end of the drive rotor 280 is projected into the space of the serve case 206.

A driven rotor 290 is rotatably held on the serve case 206 and is connected to the drive rotor 280 through a unidirectional clutch means, thus being operated in conjunction with the drive rotor 280. A frictional weight 291 is rotatably coupled to the driven rotor 290, thus being selectively brought into frictional contact with the frictional pad 205 of the annular rib 204 due to a centrifugal force generated during a unidirectional rotating action of the driven rotor 290. The frictional weight 291 is elastically biased in one direction, thus being selectively separated from the frictional pad 205 of the annular rib 204 when the seat frame 500 is raised. Meanwhile, when the seat frame 500 descends, the frictional weight 291 is brought into frictional contact with the frictional pad 205.

The unidirectional clutch means comprises a ratchet 290*a*, which is formed on the outer surface of the driven rotor 290. A plurality of pawls 281 are rotatably mounted to the end of the drive rotor 280 and selectively engage with the ratchet 290*a*. The pawls 281 are elastically biased to the ratchet 290*a*. Therefore, the pawls 281 are separated from the ratchet 290*a* due to a centrifugal force of the drive rotor 280 when the seat frame 500 is raised. Meanwhile, when the seat frame 500 descends, the pawls 281 are brought into engagement with the ratchet 290*a*.

During a lowering action of the seat frame 500, the pawls 281 allow the driven rotor 290 and the drive rotor 280 to be rotable integratedly. In addition, the frictional weight 291 comes into contact with the frictional pad 205, thus allowing the seat frame 500 to stably and safely descend at a low speed. In such a case, the centrifugal force of the frictional weight 291 is increased in proportion to the lowering speed of the seat frame 500, thereby allowing the seat frame 500 to descend at a constant speed.

As shown in FIGS. 2, 4 and 6, the braking means comprises a pair of brake lever members 294 and 295, which are provided at the outer surface of the serve case 206. Each of the brake lever members 294 and 295 has a brake pad 292, 293 which is elastically biased onto the outer surface of the driven rotor 290.

The two brake lever members 294 and 295 are elastically biased to each other by a spring 297 and so their brake pads 292 and 293 are brought into frictional contact with the outer surface of the driven rotor 290. When the brake lever members 294 and 295 are released, their brake pads 292 and 293 are separated from the outer surface of the driven rotor 290. Such an operation of the brake lever members 294 and 295 is controlled by an actuating lever 298 which is rotatably mounted to the railing 532. The above actuating lever 298 is connected to the two brake lever members 294 and 295 through a connection wire 296.

In the operation of the braking means, the two brake pads 292 and 293 are always brought into contact with the outer surface of the driven rotor 290 when the drive motor 300 is turned on or off. Particularly, when the actuating lever 298 is operated to remove a braking force with the drive motor 300 being turned off, the first and second master drive members 110 and 210 are started to rotate the two main pulleys 160 and 260, thus allowing the seat frame 500 to be lowered.

Figure 7:
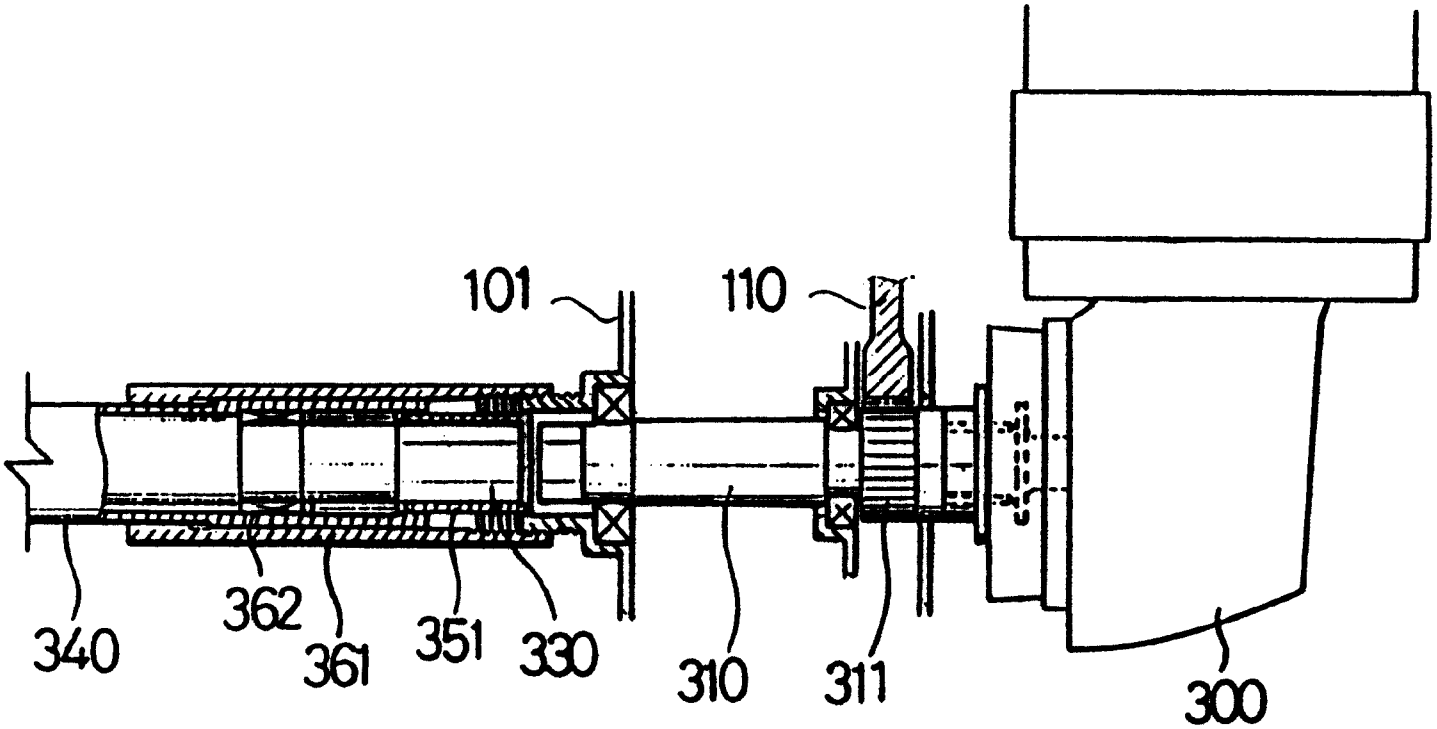
FIG. 7 is a sectional view showing the construction of a power transmission means interconnecting the first and second control units of this invention.
Figure 8A:
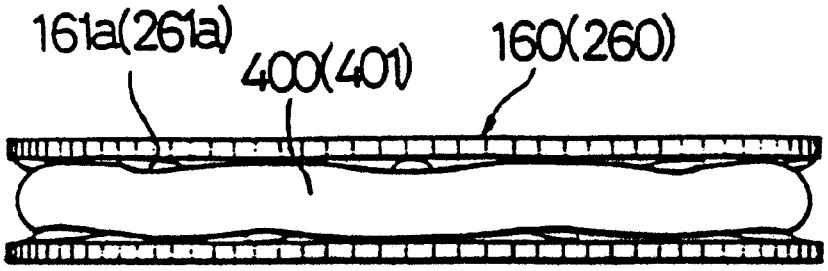
FIGS. 8*a* and 8*b* are front views of first and second main pulleys included in the outside up-down elevator of this invention.
Figure 8B:
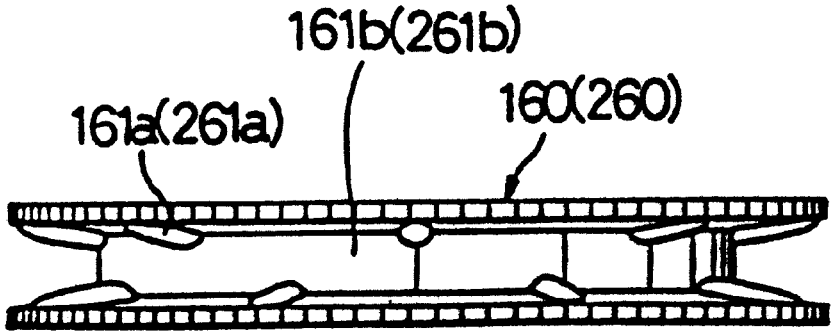
Figure 9:
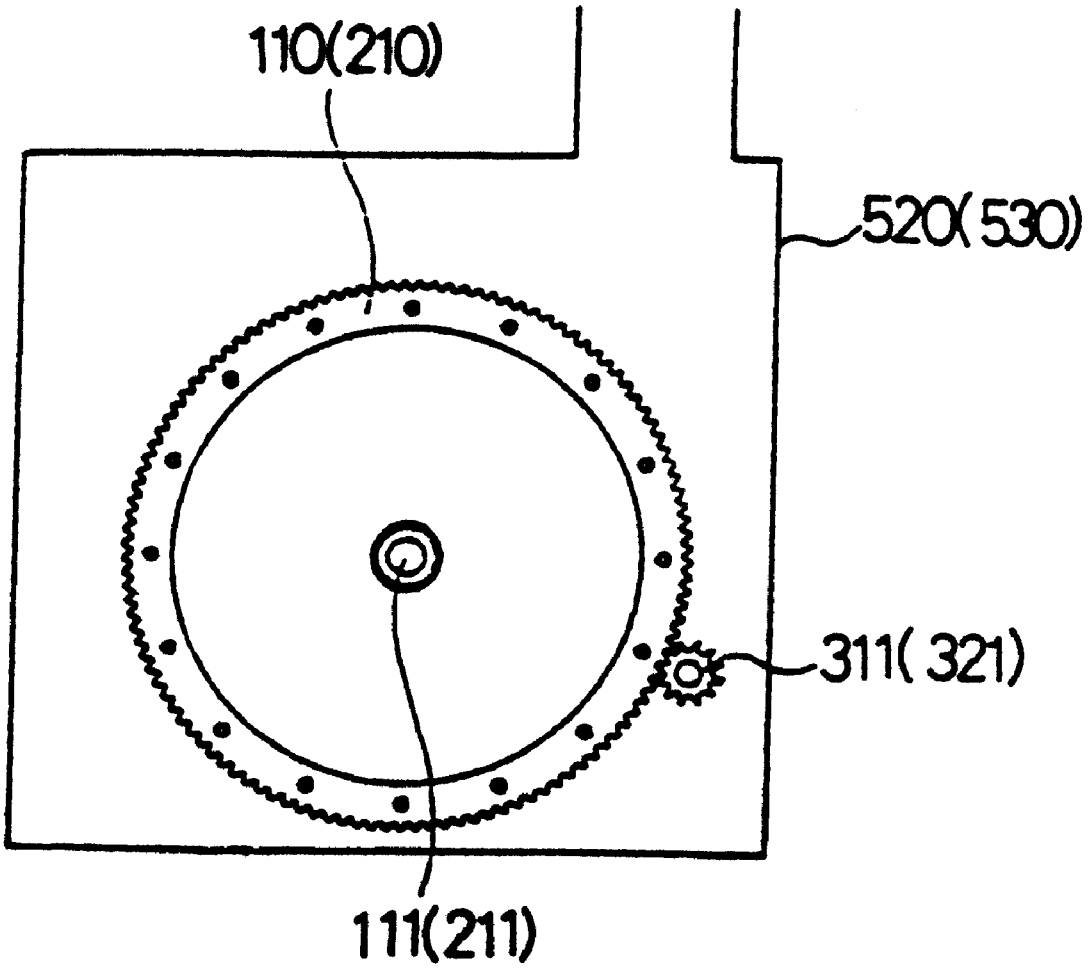
FIG. 9 is a sectional view taken along the line A—A of FIG. 4.
Figure 10:
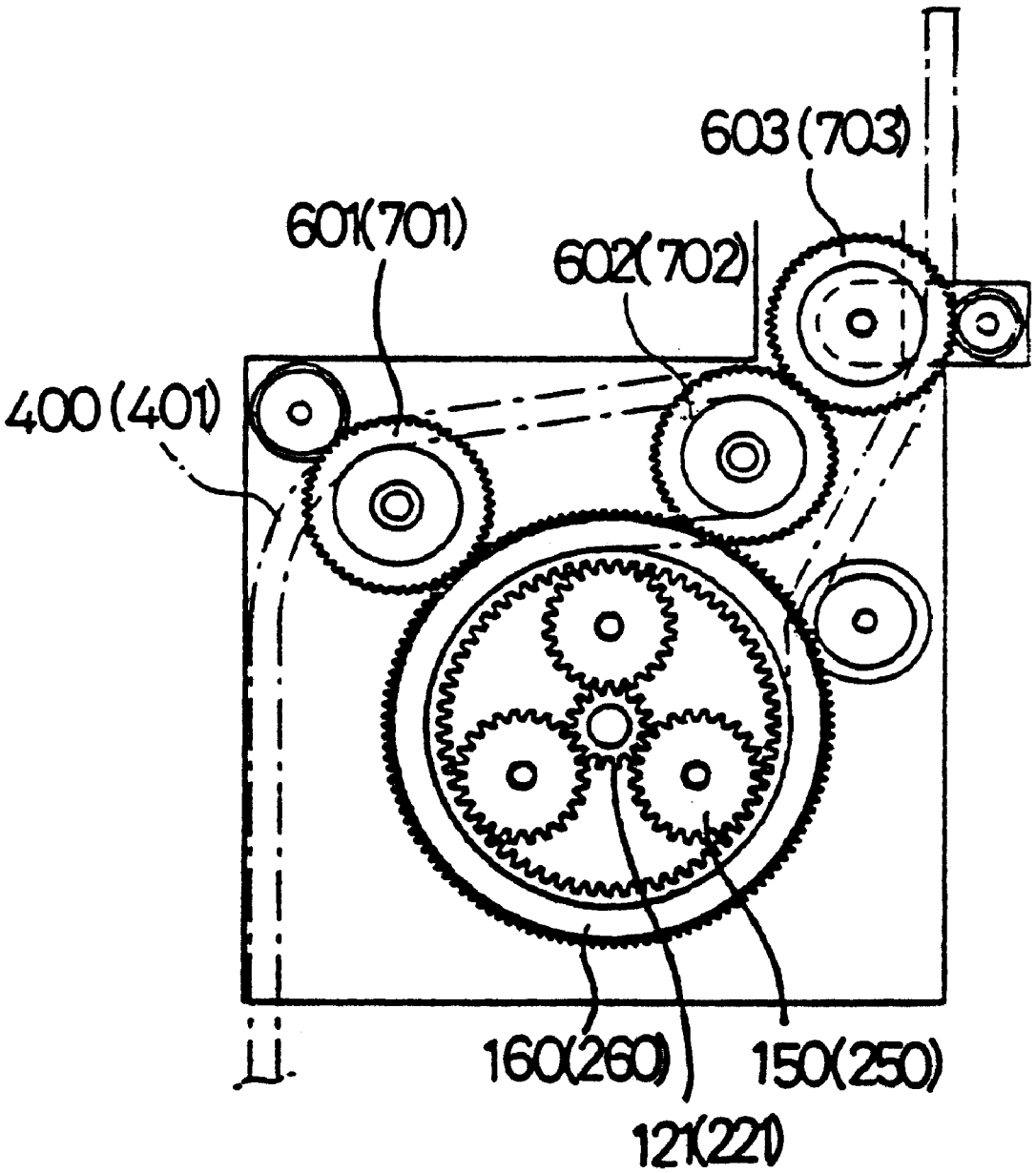
FIG. 10 is a sectional view taken along the line B—B of FIG. 4.
Figure 11:
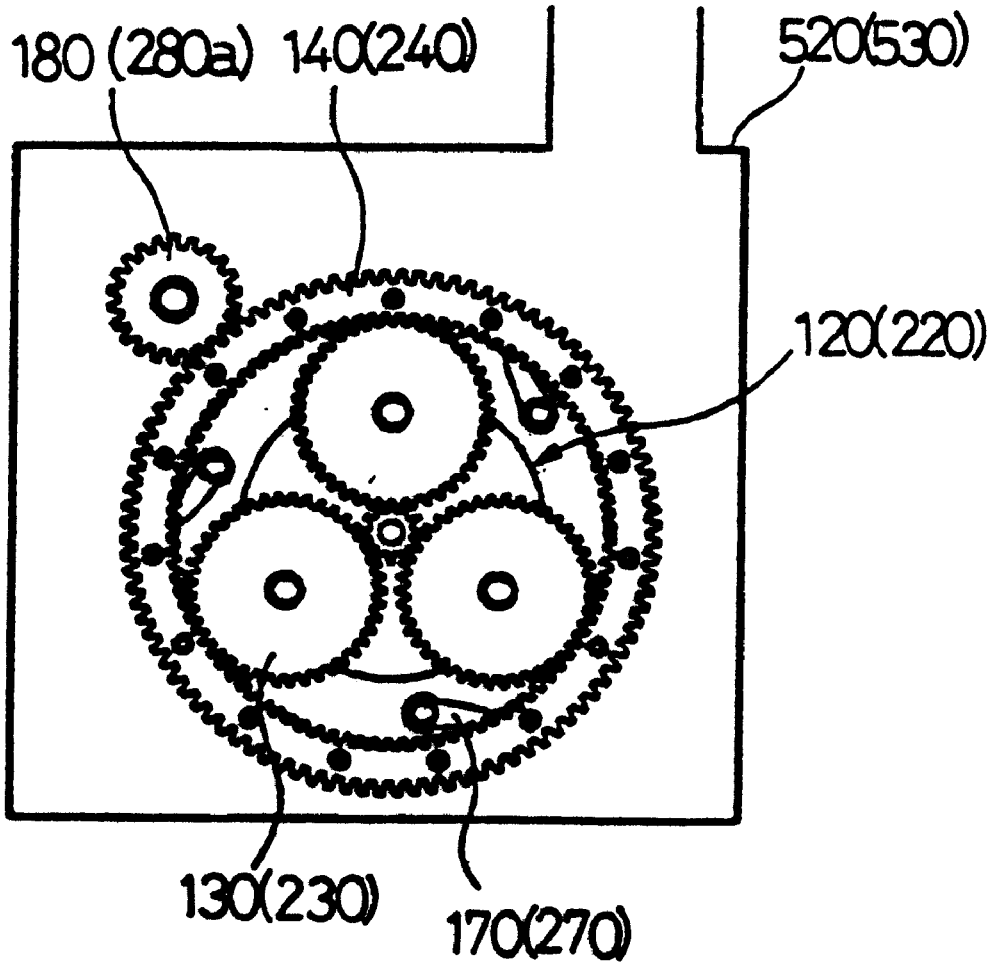
FIG. 11 is a sectional view taken along the line C—C of FIG. 4.

As shown in FIGS. 4 and 7, the power transmission means, which transmits the rotating force of the drive motor 300 to the second control unit 200, comprises a drive shaft 310, a driven shaft 320 and a connection shaft 330. The drive shaft 310 is rotatably held on the first casing 101 and has a drive gear 311 engaging with the first master drive member 110. The drive shaft 310 is also operated in conjunction with the drive motor 300. Meanwhile, the driven shaft 320 is rotatably held on the second casing 201 and has a driven gear 321 engaging with the second master drive member 210. The connection shaft 330 connects the drive shaft 310 to the driven shaft 320 by using a connection means.

In order to form the above connection means, the connection ends of the drive and driven shafts 310 and 320 have a polygonal cross-section, while both ends of the connection shaft 330, which are connected to the connection ends of the two shafts 310 and 320, have the same polygonal cross-section as that of the connection ends. The two joints between the drive, driven and connection shafts 310, 320 and 330 are individually connected by a connection bushing 350, 351. When two cap members 360 and 361 are screwed to the first and second casings 101 and 201 respectively, the connection bushings 350 and 351 are moved, thus connecting the drive and driven shafts 310 and 320 to the connection shaft 330. The connection shaft 330 is encased within a protection pipe 340, thus being protected from any external shock. A compression coil spring 362 is interposed between the two cap members 360 and 361, thus retaining the two connection bushings 350 and 351 at their positions on the joints.

The connection shaft 330, which is encased within the protection pipe 340, extends across the back wall 510. Therefore, it is preferable to provide a protection plate (not shown) on the back wall 510 so as to protect both the connection shaft 330 and the protection pipe 340 from any external impact.

As shown in FIGS. 5, 6, 8*a* and 8*b*, the first and second main pulleys 160 and 260 are individually provided with a plurality of zigzag guide ribs 161*a*, 261*a* on opposite walls of the rope wrapping groove 161, 261. Therefore, the first and second ropes 400 and 401 can be stably wound around or unwound from the pulleys 160 and 260 while being brought into frictional contact with the zigzag guide ribs 161*a* and 261*a*.

In each of the two main pulleys 160 and 260, the width of the groove's bottom 161*b*, 261*b* is equal to the diameter of each rope 400, 401, thus preventing the ropes 400 and 401 from being deformed when the ropes 400 and 401 are wound around the pulleys 160 and 260. Such a width of the groove's bottom 161*b*, 261*b* also allows the ropes 400 and 401 to be stably wound around or unwound from the pulleys 160 and 260 while being brought into frictional contact with the zigzag guide ribs 161*a* and 261*a*.

As shown in FIGS. 4 and 6, a plurality of guide rollers 601 to 603, 701 to 703 are provided on the outer surface of each of the main pulleys 160 and 260 for preventing the ropes 400 and 401 from unexpectedly slipping on or being removed from the pulleys 160 and 260. In the present invention, it is preferable to design the guide rollers to be engaged with an associated main pulley 160, 260.

The operational effect of the above outside up-down elevator will be described hereinbelow.

1. A lifting action:

In order to lift the seat frame 500, the drive motor 300 is turned on. When the drive motor 300 is started, the first and second master drive members 110 and 210 are rotated counterclockwise, thus rotating the first and third planetary gears 130 and 230 clockwise and rotating the first and second gear carriers 120 and 220 counterclockwise.

In such a case, the first and second ring gears 140 and 240 are stopped by the first and second clicks 170 and 270 respectively, and so each of the first and second gear carriers 120 and 220 is rotated at a primarily-reduced speed. In addition, the second and fourth planetary gears 150 and 250, which respectively engage with the second and fourth sun gears 121 and 221 of the first and second gear carriers 120 and 220, are rotated clockwise, while the first and second main pulleys 160 and 260 are rotated clockwise, thus winding the ropes 400 and 401. The rotating speed of the first and second main pulleys 160 and 260 is secondarily reduced and allows the seat frame 500 to be raised at a low speed.

Meanwhile, when the second master drive member 210 is rotated counterclockwise, the drive rotor 280 is rotated clockwise and allows the pawls 281 to be separated from the ratchet 290*a* of the driven rotor 290 due to a centrifugal force of the drive rotor 280. The first and second master drive members 110 and 210 are thus rotated irrespective of a braking force of the braking means.

2. A lowering action:

In order to lower the seat frame 500, the drive motor 300 is turned off. In such a case, the seat frame 500 is to descend along the two ropes 400 and 401. However, the seat frame 500 is stably maintained at its stop position by the braking means. That is, the two brake pads 292 and 293 are brought into close contact with the outer surface of the driven rotor 290, thereby stopping the driven rotor 290. The pawls 281 come into engagement with the ratchet 290*a* of the driven rotor 290, thus stopping the drive rotor 280 and stopping the first and second main pulleys 160 and 260. When the two main pulleys 160 and 260 are stopped as described above, the two ropes 400 and 401 are maintained at their stop positions due to the frictional force between the ropes 400 and 401 and the guide ribs 161*a* and 261*a* of the pulleys 160 and 260, thus almost completely preventing the seat frame 500 from being lowered.

Meanwhile, when the actuating lever 298 is operated to separate the brake pads 292 and 293 from the driven rotor 290, the first and second main pulleys 160 and 260 are free from any braking force, thus being rotated counterclockwise. In such a case, the second and fourth planetary gears 150 and 250 are rotated counterclockwise, while the first and second gear carriers 120 and 220 are rotated at an increased speed.

The first and third planetary gears 130 and 230, which are mounted on the first and second gear carriers 120 and 220 respectively, are rotated counterclockwise and revolve clockwise at the same time. In the above state, the first and second master drive members 110 and 210 are rotated clockwise, while the drive rotor 280 is rotated counterclockwise with the pawls 281 of the drive rotor 280 being brought into engagement with the ratchet of the driven rotor 290. Therefore, the rotating speed of the driven rotor 290 is increased in proportion to the gear ratio of the rotor 290 to the second master drive member 210. In addition, the frictional weight 291 comes into frictional contact with the frictional pad 205 due to a centrifugal force. In such a case, since the centrifugal force for the weight 291 is increased in proportion to the rotating speed of the driven rotor 290, the seat frame 500 is lowered at a constant speed.

As shown in FIGS. 3 to 6 and 11, it is possible to manually adjust horizontality of the seat frame 500 when the frame 500 fails to be placed at a completely horizontal position during an installation work of the outside up-down elevator. That is, when the seat frame 500, supported by the ropes 400 and 401, is not placed at its horizontal position, the adjusting gears 180 and 280*a* of an adjusting means are brought into engagement with the first and second ring gears 140 and 240, thus selectively rotating the first and second ring gears 140 and 240 and precisely placing the seat frame 500 at its horizontal position. The first and second casings 101 and 201 are provided with openings (not shown) for allowing the adjusting gears 180 and 280*a* to pass through.

As described above, the present invention provides an outside up-down elevator, which is designed to be smoothly and safely raised without an initial downward movement when the outside up-down elevator is restarted in an ascending direction after it is temporarily stopped due to an obstacle in a moving passage of the outside up-down elevator during an operation. That is, when an actuating lever is not operated, the outside up-down elevator is always braked by a braking means. However, the braking means releases the outside up-down elevator when the lever is operated, thus allowing the outside up-down elevator to descend. During an ascending action of the outside up-down elevator, the outside up-down elevator is always braked by the braking means. Therefore, the outside up-down elevator is thus almost completely free from any downward movement even when a drive motor is turned off and stops the outside up-down elevator.

During the operation of the outside up-down elevator of this invention, the outside up-down elevator may be lowered at an increased speed. However, the outside up-down elevator is provided with a constant speed control means, which increases the frictional force of a frictional weight in proportion to the increased speed of the outside up-down elevator. The outside up-down elevator thus stably and safely descends at a constant speed.

In the outside up-down elevator of this invention, a seat frame is moved upward or downward under the guide of two ropes, thereby allowing a worker to work safely and stably without having any intervention between the ropes and the worker and improving work efficiency while working.

Two side walls, respectively enclosing first and second control units, are hinged to both side edges of the seat frame and so the outside up-down elevator of this invention can be fully folded suitable for being transported by a user.

In addition, horizontality of the seat frame can be manually adjusted by using two adjusting gears without disassembling the outside up-down elevator, thus being convenient to a user.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An outside up-down elevator comprising:

a folding seat frame used for taking on a passenger;

at least two ropes or first and second ropes attached to a building;

a first control unit provided at one side wall of said seat frame and adapted for winding the first rope in a specific pattern;

a drive motor used for generating a rotating force, thus selectively operating said first control unit;

a second control unit provided at an opposite side wall of said seat frame and adapted for winding the second rope in a specific pattern;

power transmission means for transmitting the rotating force of said drive motor to the second control unit; and braking means for selectively braking and stopping the seat frame upon a lowering action of the seat frame, wherein said seat frame is selectively raised along the ropes by the rotating force of said drive motor or descends due to the total weight of the seat frame including the weight of the person when the drive motor is turned off.

2. The outside up-down elevator according to claim 1, wherein said seat frame comprises:

a bottom panel used for supporting the passenger;

a vertical connection wall extending from a rear edge of said bottom panel to a height; and a back wall jointed to a top edge of said connection wall through a plurality of hinges, said back wall allowing the passenger to lean back against it.

3. The outside up-down elevator according to claim 2, wherein said seat frame further comprises:

two side walls rotatably attached to both side edges of the back wall and adapted for receiving the first and second control units respectively, said two side walls being selectively closed and interposed between the bottom panel, the connection wall and the back wall when the seat frame is fully folded suitable for being transported by a user; and two guide members fixedly attached to the two side walls and adapted for guiding the two ropes to the first and second control unit, respectively.

4. The outside up-down elevator according to claim 1, wherein said first control unit comprises:

a first casing provided with rope inlet and outlet ports for the first rope with the interior of said casing being divided into regular sections by a plurality of intermediate plates;

a first main pulley provided in said first casing and having a rope wrapping groove on its outer surface, said first main pulley being operated by the rotating force of the drive motor; and a first speed control means adapted for controlling a rotating speed of the first main pulley.

5. The outside up-down elevator according to claim 4, wherein said first speed control means comprises:

a first shaft rotatably mounted to the first casing and having a first sun gear at a first end thereof;

a first master drive member fitted over a second end of the first shaft and connected to the drive motor, thus being operated by the rotating force of the motor;

a first gear carrier rotatably fitted over a middle portion of the first shaft and having a second sun gear at its outer surface;

a plurality of first planetary gears rotatably held on the first gear carrier at regular intervals and commonly externally engaging with the first sun gear;

a first ring gear fixed to the first casing through first fixing means and internally engaging with the first planetary gears; and a plurality of second planetary gears rotatably positioned between the intermediate plates at regular intervals, said second planetary gears commonly externally engaging with the second sun gear and internally engaging with a gear part formed on the inner surface of the first main pulley.

6. The outside up-down elevator according to claim 5, wherein said first fixing means comprises:

a first click rotatably mounted to one of the intermediate plates of the first casing and engaging with an inner gear part of the first ring gear, thus only allowing the first ring gear to be rotatable in one direction.

7. The outside up-down elevator according to claim 1, wherein said second control unit comprises:

a second casing provided with rope inlet and outlet ports for the second rope with the interior of said casing being divided into regular sections by a plurality of intermediate plates;

a second main pulley provided in said second casing and having a rope wrapping groove on its outer surface, said second main pulley being operated by the rotating force of the drive motor transmitted thereto through the power transmission means; and a second speed control means adapted for controlling a rotating speed of the second main pulley.

8. The outside up-down elevator according to claim 4, wherein the rope wrapping groove of each of said first and second main pulleys is formed by:

a bottom surface having the same width as a diameter of each of said first and second ropes; and opposite walls extending from both edges of the bottom surface and individually having a plurality of zigzag guide ribs on an inner surface.

9. The outside up-down elevator according to claim 7, wherein said second speed control means comprises:

a second shaft rotatably mounted to the second casing and having a third sun gear at a first end thereof;

a second master drive member fitted over a second end of the second shaft and connected to the drive motor, thus being operated by the rotating force of the motor;

a second gear carrier rotatably fitted over a middle portion of the second shaft and having a fourth sun gear at its outer surface;

a plurality of third planetary gears rotatably held on the gear carrier at regular intervals and commonly externally engaging with the third sun gear;

a second ring gear fixed to the second casing through second fixing means and internally engaging with the third planetary gears; and a plurality of fourth planetary gears rotatably positioned between the intermediate plates at regular intervals, said fourth planetary gears commonly externally engaging with the fourth sun gear and internally engaging with a gear part formed on the inner surface of the second main pulley.

10. The outside up-down elevator according to claim 9, wherein said second fixing means comprises:

a second click rotatably mounted to one of the intermediate plates of the second casing and engaging with an inner gear part of the second ring gear, thus only allowing the second ring gear to be rotatable in one direction.

11. The outside up-down elevator according to claim 1, further comprising:

constant speed control means used for allowing the seat frame to move at a constant speed when the seat frame descends along the two ropes under the control of the first and second control units.

12. The outside up-down elevator according to claim 11, wherein said constant speed control means comprises:

a serve case provided outside the second casing and defining a space therein;

an annular rib extending from the second casing into the space of said serve case;

a drive rotor rotatably mounted to the second casing, said drive rotor rotatably engaging with the second master drive member at a first end thereof and projecting into the space of the serve case at a second end thereof;

a driven rotor rotatably held on the serve case and connected to the drive rotor through unidirectional clutch means, thus being rotatable in conjunction with the drive rotor;

a frictional pad provided on an inner surface of the annular rib; and a frictional weight rotatably coupled to the driven rotor, thus being selectively brought into frictional contact with the frictional pad of the annular rib due to a centrifugal force generated during a unidirectional rotating action of the driven rotor.

13. The outside up-down elevator according to claim 12, wherein said unidirectional clutch means comprises:

a ratchet provided on an outer surface of the driven rotor; and a plurality of pawls rotatably mounted to an end of the drive rotor and elastically biased to the ratchet, thus being selectively brought into engagement with or separated from the ratchet in accordance with a rotating direction of the drive rotor.

14. The outside up-down elevator according to claim 1, wherein said power transmission means comprises:

a drive shaft rotatably held on the first casing and having a drive gear engaging with the first master drive member, said drive shaft being operated in conjunction with the drive motor;

a driven shaft rotatably held on the second casing and having a driven gear engaging with the second master drive member; and a connection shaft interconnecting the drive and driven shafts to each other by using connection means.

15. The outside up-down elevator according to claim 14, wherein said connection means comprises:

a polygonal end formed at each interconnected end of each of the drive, driven and connection shafts; and two connection bushings adapted for connecting both ends of the connection shaft to the drive shaft and the driven shaft, respectively.

16. The outside up-down elevator according to claim 14, wherein said connection shaft is encased within a protection pipe, thus being protected from any external shock.

17. The outside up-down elevator according to claim 1, wherein said braking means comprises:

a pair of brake lever members provided at an outer surface of the serve case; and a brake pad provided at one end of each of the brake lever members and elastically biased onto the outer surface of the driven rotor, thus being selectively brought into frictional contact with or separated from the outer surface of the driven rotor in accordance with a rotating action of an associated brake lever member.

18. The outside up-down elevator as defined in claim 7, wherein the rope wrapping groove of each of said first and second main pulleys is formed by:

a bottom surface having the same width as a diameter of each of said first and second ropes; and opposite walls extending from both edges of the bottom surface and individually having a plurality of zigzag guide ribs on an inner surface.

19. The outside up-down elevator as defined in claim 9, further comprising:

constant speed control means used for allowing the seat frame to move at a constant speed when the seat frame descends along the two ropes under the first and second control units.

20. The outside up-down elevator as defined in claim 15, wherein said connection shaft is encased within a protection pipe, thus being protected from any external shock.

* * * * *